US006178252B1

(12) United States Patent
Frasl et al.

(10) Patent No.: US 6,178,252 B1
(45) Date of Patent: Jan. 23, 2001

(54) ELECTROACOUSTIC TRANSDUCER COMPRISING A DIAPHRAGM HAVING THROUGH PORTIONS FOR MOUNTING A VOICE COIL

(75) Inventors: Ewald Frasl, Biedermannsdorf; Erich Klein, Himberg, both of (AT)

(73) Assignee: U.S. Philips Corporation, New York, NY (US)

( * ) Notice: Under 35 U.S.C. 154(b), the term of this patent shall be extended for 0 days.

(21) Appl. No.: 09/249,969

(22) Filed: Feb. 12, 1999

(30) Foreign Application Priority Data

Feb. 17, 1998 (EP) ..... 98890045

(51) Int. Cl.[7] ..... H04R 25/00

(52) U.S. Cl. ..... 381/424; 381/398; 381/423; 181/164; 181/173

(58) Field of Search ..... 381/423, 424, 381/430, 124, 184, 185, 398, 400, 405, 407; 181/148, 157, 164, 165, 173

(56) References Cited

U.S. PATENT DOCUMENTS

| | | | | |
|---|---|---|---|---|
| 3,132,713 | * | 5/1964 | Seeler | 381/423 |
| 5,303,209 | | 4/1994 | Frasl | 367/174 |
| 6,075,866 | * | 6/2000 | Frasl et al. | 381/423 |

FOREIGN PATENT DOCUMENTS

| | | | |
|---|---|---|---|
| 4312159 | 6/1994 | (DE) | H04R/7/12 |

* cited by examiner

*Primary Examiner*—Curtis A. Kuntz
*Assistant Examiner*—Suhan Ni
(74) *Attorney, Agent, or Firm*—Steven R. Biren

(57) ABSTRACT

An electroacoustic transducer (1) having a voice coil (17) and having a diaphragm (19) with an annular intermediate zone (22) for securing the voice coil (17), the intermediate zone (22) having angularly spaced-apart trough portions (29) which are each bounded by a trough bottom wall (30) and two trough side walls (31, 32), and the voice coil (17) being secured to the trough bottom walls (30).

6 Claims, 2 Drawing Sheets

ELECTROACOUSTIC TRANSDUCER COMPRISING A DIAPHRAGM HAVING THROUGH PORTIONS FOR MOUNTING A VOICE COIL

BACKGROUND OF THE INVENTION

1. Field of the Invention

The invention relates to an electroacoustic transducer comprising a voice coil and further comprising a diaphragm which is intended for cooperation with an air mass in an acoustic free space situated in front of the diaphragm and which can be set into vibration by means of the voice coil substantially parallel to a direction of vibration. The diaphragm has an annular outer zone, end a central zone which is convex with respect to the acoustic free space situated in front of the diaphragm, and a peripheral zone which diverges towards the acoustic free space in front of the diaphragm. The peripheral zone is connected to the central zone by an annular intermediate zone and terminates in the outer zone of the diaphragm, the annular intermediate zone being constructed for securing the voice coil of the transducer to the diaphragm.

The invention further relates to a diaphragm for an electroacoustic transducer, which diaphragm is intended for cooperation with an air mass in an acoustic free space situated in front of the diaphragm, and which can be set into vibration by means of a voice coil substantially parallel to a direction of vibration. The diaphragm has an annular outer zone a central zone which is convex with respect to the acoustic free space situated in front of the diaphragm, and a peripheral zone which diverges towards the acoustic free space in front of the diaphragm. The peripheral zone is connected to the central zone by an annular intermediate zone and terminates in the outer zone of the diaphragm, the annular intermediate zone of the diaphragm being constructed for securing the voice coil of the transducer to the diaphragm.

2. Description of the Related Art

An electroacoustic transducer of the type defined in the first paragraph and a diaphragm of the type defined in the second paragraph are known, for example, from the document U.S. Pat. No. 5,303,209. It is to be noted that a known transducer of the type defined in the first paragraph is commercially available from the Applicant in several versions, for example, under the type number WD 02901/Y50L. In the known transducer, the convex central zone is spherical and the diverging peripheral zone has a flared shape corresponding to a part of a torus. In the known transducer, the annular intermediate zone, which serves as a mounting zone for securing the voice coil of the transducer to the diaphragm, takes the form of an annular disc, a plane through this annular disc extending perpendicularly to the transducer axis. Due to this shape of the intermediate zone in the known transducer, this intermediate zone is situated comparatively far away from the magnet system of the known transducer, as a result of which the voice coil must be comparatively high in order to extend into the air gap of the magnet system. This, in turn, results in the voice coil being comparatively heavy, which is unfavorable for a maximal sensitivity—i.e., for a maximal conversion factor between the applied electric power and the delivered sound pressure—and which also makes the voice coil more expensive, because the voice coil should have a comparatively large number of turns in order to obtain the required height. Moreover, as a result of the comparatively high voice coil, the position of the voice coil with respect to the air gap of the magnet system exhibits a comparatively high degree of asymmetry, which leads to a comparatively large amount of non-linear distortion in the known transducer.

SUMMARY OF THE INVENTION

It is an object of the invention to preclude the above-mentioned problems in a simple manner and by simple means and to provide an improved electroacoustic transducer and an improved diaphragm for an electroacoustic transducer.

According to the invention, in order to achieve the aforementioned object with an electroacoustic transducer of the type defined in the first paragraph, the annular intermediate zone has angularly spaced-apart portions which are substantially trough-shaped in cross-section and which are each bounded by a trough bottom wall and two trough side walls, of which each radially inner trough side wall adjoins the central zone and each radially outer trough side wall adjoins the peripheral zone. In each of these trough portions the bottom wall is connected to the side walls at those ends of the side walls which are remote from the free space in front of the diaphragm.

Thus, it is achieved by simple means that by means of its trough portions—strictly speaking by means of the bottom walls of the trough portions—the intermediate diaphragm-zone, which is adapted to secure the voice coil of the transducer forms the actual mounting zone for securing the voice coil of the transducer. The mounting zone—as compared with a known mounting zone having the shape of an annular disc—is situated distinctly closer to the air gap of the magnet system of the transducer in accordance with the invention due to the trough shape of the trough portions, as a result of which the voice coil of a transducer in accordance with the invention can have a distinctly smaller height and is also disposed comparatively symmetrically with respect to the air gap of the magnet system. This provides a transducer having an improved sensitivity and a reduced susceptibility to nonlinear distortion as compared with a known transducer.

In a transducer in accordance with the invention having the characteristic features as defined above it has proved to be particularly advantageous if, in addition, viewed in a tangential direction, a first wedge portion adjoins each trough portion at one end and a second wedge portion at the other end, and each first wedge portion is bounded by a radial prolongation of the central zone of the diaphragm and by a tangential prolongation of the radially outer trough side wall of the adjacent trough portion, and each second wedge portion is bounded by a radial prolongation of the peripheral zone of the diaphragm and by a tangential prolongation of the radially inner trough side wall of the adjacent trough portion. The first wedge portions and the second wedge portions provide a distinct increase in stiffness of the annular intermediate zone, which is very advantageous in order to obtain a diaphragm having a maximal stiffness, the high stiffness of the diaphragm resulting in very good acoustic characteristics of such a transducer in accordance with the invention.

In a transducer in accordance with the invention having the characteristic features as defined above it has further proved to be advantageous if, in addition, the diaphragm has been manufactured by means of a deep-drawing process. With such a deep-drawing process the diaphragm of a transducer in accordance with the invention can be manufactured with a high precision, the deep-drawing process enabling even very small the diaphragm thicknesses of only a few hundredths of millimeters to be manufactured accurately and reproducibly, which is highly important particularly in the case of miniaturized electroacoustic transducers having only very small and thin diaphragms. It is to be noted that these measures can also be applied advantageously to a transducer in accordance with the invention having the characteristic features of the first and second wedge portions as defined above.

According to the invention, in order to achieve the aforementioned object with a diaphragm of the type defined in the second paragraph the annular intermediate zone has angularly spaced-apart trough portions which are substantially trough-shaped in cross-section and which are each bounded by a trough bottom wall and two trough side walls, of which trough side walls each radially inner trough side wall adjoins the central zone and each radially outer trough side wall adjoins the peripheral zone, and in each of these trough portions the trough bottom wall is connected to the trough side walls at those ends of the trough side walls which are remote from the free space in front of the diaphragm. In this way, advantages which correspond to the advantages described hereinbefore for a transducer in accordance with the invention having the characteristic features defined above are obtained for a diaphragm in accordance with the invention.

The advantageous variants of a diaphragm in accordance with the invention, which variants have the characteristic features of the first and second wedge portions as defined above, yield advantages which correspond to the advantages described above for the advantageous variants of a transducer in accordance with the invention.

The above-mentioned as well as further aspects of the invention will become apparent from the embodiment described hereinafter by way of example and will be elucidated by means of this embodiment.

BRIEF DESCRIPTION OF THE DRAWINGS

The invention will now be described in more detail with reference to the drawings, which show an example of an embodiment to which the invention is not limited, in which.

DESCRIPTION OF THE PREFERRED EMBODIMENTS

Figure 1:
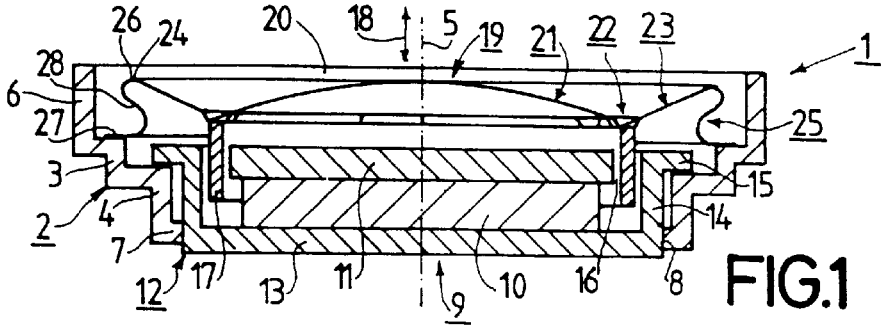
FIG. 1 shows in a partly diagrammatic cross-sectional view to an enlarged scale, i.e. approximately 7 times full scale, an electroacoustic transducer in accordance with a first embodiment of the invention, which is constructed as a loudspeaker and which comprises a diaphragm in accordance with an embodiment of the invention.
Figure 2:
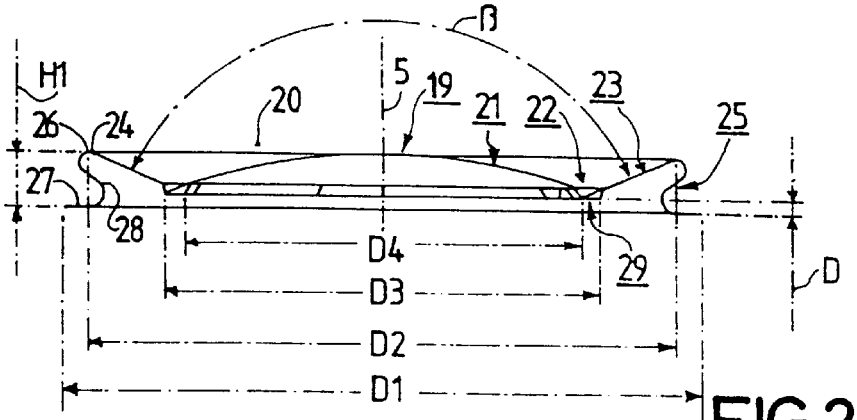
FIG. 2, in a view similar to that of FIG. 1, shows the diaphragm and the diaphragm supporting means of the transducer of FIG. 1, which form a single part with the diaphragm.

FIG. 1 shows an electroacoustic transducer 1, which is referred to briefly as the transducer 1 and is constructed as a loudspeaker. The transducer 1 comprises a plastic housing 2 having a first stepped portion 3 and a second stepped portion 4, these stepped portions 3 and 4 adjoining one another. A hollow cylindrical housing portion 6, which extends in the direction of a transducer axis 5, is connected to the first stepped portion 3. A plate-shaped housing portion 7 having a circularly cylindrical passage 8 is connected to the second stepped portion 4.

The transducer 1 has a magnet system 9. The magnet system 9 comprises a magnet 10 and a pole plate 11 and a pot 12, often referred to as outer pot and comprising a pot bottom 13, a hollow cylindrical pot portion 14 and a pot collar 15 which projects radially from the pot portion 14. The entire magnet system 9 is secured to the second stepped portion 4 of the housing 2 by the pot collar 15 of the pot 12, in that an adhesive joint is formed between the pot collar 15 and the second stepped portion 4. The pot 12 of the magnet system 9 extends with its pot bottom 13 through the passage 8 in the plate-shaped housing portion 7, a mechanically and acoustically imperforate joint being formed by a press-fit between the plate-shaped housing portion 7 and the pot 12, but this joint may alternatively be an adhesive joint.

Between the circumferential bounding surface of the pole plate 11 and the surface of the hollow cylindrical pot portion 14 which faces the pole plate 11, an air gap 16 is formed. A voice coil 17 of the transducer I is disposed partly in the air gap 16. By means of the magnet system 9, the voice coil 17 can be set into vibration substantially parallel to a direction of vibration, which is indicated by means of a double arrow 18 and extends parallel to the transducer axis 5. The voice coil 17 is connected to a diaphragm 19 of the transducer 1, the construction of said diaphragm being described in detail hereinafter.

The diaphragm 19 of the transducer 1 serves to cooperate with an air mass in an acoustic free space situated in front of the diaphragm 19. By means of the voice coil 17, the diaphragm 19 can be set into vibration substantially parallel to the direction 18 of vibration.

In an advantageous manner, the present diaphragm 19 has a substantially spherical central zone 21 which is convex with respect to the acoustic free space 20 disposed in front of the diaphragm 19. The diaphragm 19 further has a peripheral zone 23 which, in the present case, is frustoconical, diverging towards the acoustic free space 20 in front of the diaphragm 19, this peripheral zone being connected to the central zone 21 by an annular intermediate zone 22 and terminating in an annular outer zone 24 of the diaphragm 19. Advantageously, the construction of the diaphragm 19 is such that in spite of its division into the central zone 21, the intermediate zone 22 and the peripheral zone 23, the diaphragm 19 is inherently stiff, which is advantageous in view of good acoustic properties of the diaphragm 19 and, consequently, of the transducer 1. The annular intermediate zone 22 of the diaphragm 19 of the transducer I is adapted to secure the voice coil 17 of the transducer 1 to the diaphragm 19. The structure of the annular intermediate zone 22 and the connection of the voice coil 17 to this intermediate zone 22 is described in detail hereinafter.

To secure the diaphragm 19 to the housing 2, the transducer I has supporting means 25. The supporting means 25 comprises a first annular zone 26 connected to the annular outer zone 24 of the diaphragm 19, a second annular zone 27 connected to the housing 2, namely, to the first stepped portion 3, and a connecting zone 28 which connects the first annular zone 26 and the second annular zone 27 to one another. The connecting zone 28 has a corrugated cross-sectional shape. The orientation of the connecting zone 28 corresponds, at least substantially to the direction 18 of vibration of the diaphragm 19. With respect to the connecting zone 28, it is to noted that the connecting zone 28 is elastically compliant parallel to the direction 18 of vibration of the diaphragm 19.

Advantageously, the diaphragm 19 and the supporting means 25 for the diaphragm 19 form a single part, as is apparent from the FIGS. 1 to 5. The annular outer zone 24 of the diaphragm 19 and the first annular zone 26 of the supporting means 25 adjoin one another smoothly, as is apparent from FIGS. 4 and 5. Since the diaphragm 19 and the supporting means 25 for the diaphragm 19 form a single part, it is achieved that the diaphragm 19 including its supporting means 25 can be connected to the housing 2 of the transducer 1 in a single operation. In order to connect the supporting means 25 to the housing 2, an adhesive joint is formed between the second annular zone 27 of the supporting means 25 and the first stepped portion 3 of the housing 2. Moreover, since the diaphragm 19 and the supporting means 25 for the diaphragm 19 form a single part, a very accurate construction for the diaphragm 19 including the supporting means 25 as well as a very accurate positioning of the diaphragm 19 in the housing 2 of the transducer 1 and, consequently, a very accurate positioning of the voice coil 17, which is connected to the diaphragm 19, are guaranteed, which is important and advantageous for a correct operation of the transducer 1.

In the transducer 1 shown in FIG. 1, the diaphragm 19 and the supporting means 25, which form a single part, have been manufactured by means of a deep-drawing process. A deep-drawing process is of great advantage because it enables the diaphragm 19 and the supporting means 25 for the diaphragm 19 to be manufactured with very thin walls and yet with a uniform material thickness, as a result of which a very light-weight diaphragm 19 can be obtained, which is particularly important and advantageous in the present case of a miniaturized transducer.

In the transducer 1 shown in FIG. 1, the construction of the supporting means 25 is such that the connecting zone of the supporting means 25 is cross-sectionally S-shaped. Furthermore, as regards the supporting means 25 it is to be noted that, viewed parallel to the direction 18 of vibration of the diaphragm 19, the connecting zone 28 of the supporting means 25 has such a dimension that the second annular zone 27 of the supporting means 25, which zone is connected to the housing 2, is spaced at a given distance D from the diaphragm 19 in a direction parallel to the direction 18 of vibration and away from the acoustic free space 20 situated in front of the diaphragm 19, as is apparent from FIGS. 4 and 5. The S-shape of the connecting zone 28 and the fact that the second annular zone 27 is spaced from the diaphragm 19 result in the advantage that compliant supporting means 25 are obtained, which is advantageous in view of good acoustic properties of the transducer 1.

Hereinafter, the annular intermediate zone 22 of the diaphragm 19 will be described in more detail. The intermediate zone 22 serves for securing the voice coil 17 of the transducer 1 to the diaphragm 19. Thus, the intermediate zone forms a mounting zone for securing the voice coil 17.

Figure 3:
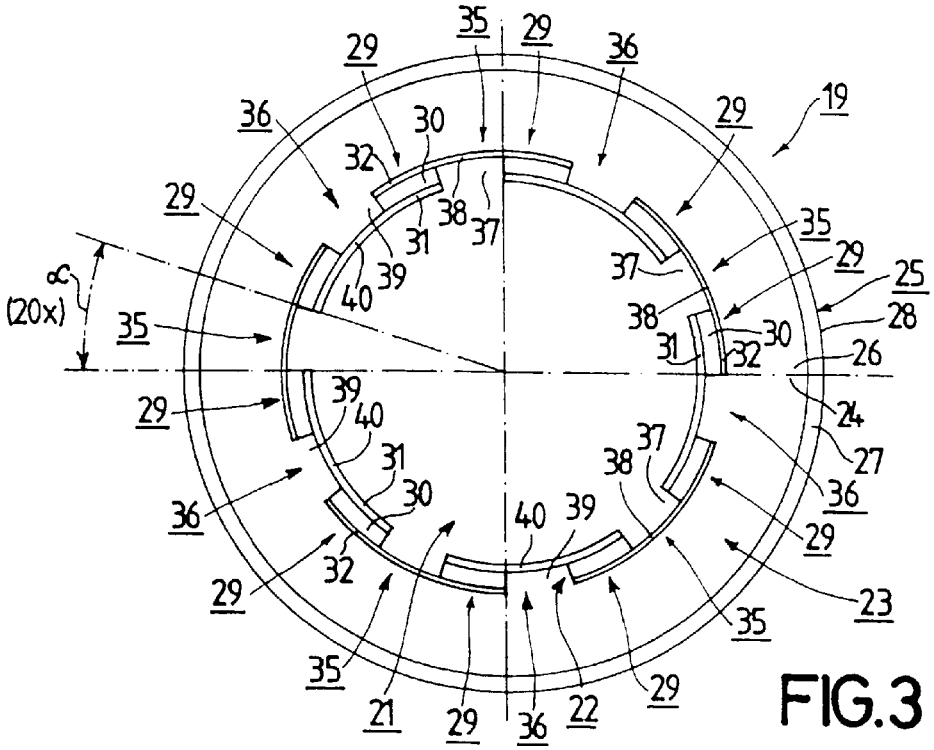
FIG. 3 is a plan view which shows the diaphragm of FIG. 2 including its supporting means.
Figure 4:
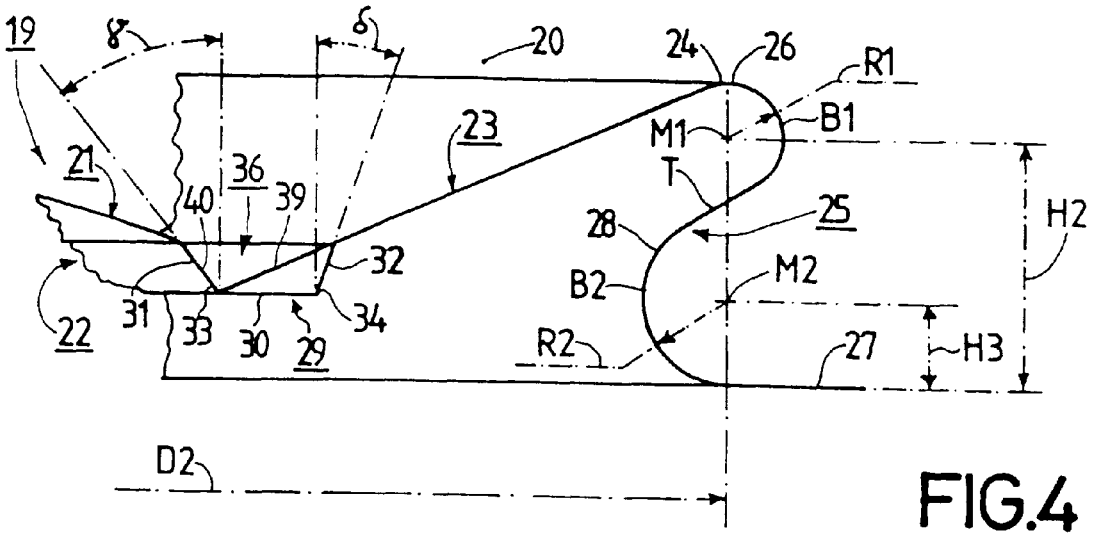
FIG. 4 shows a peripheral area of the diaphragm of FIG. 2 including the supporting means connected to the diaphragm in a view similar to that of FIG. 2 but to a substantially larger scale than FIG. 2.
Figure 5:
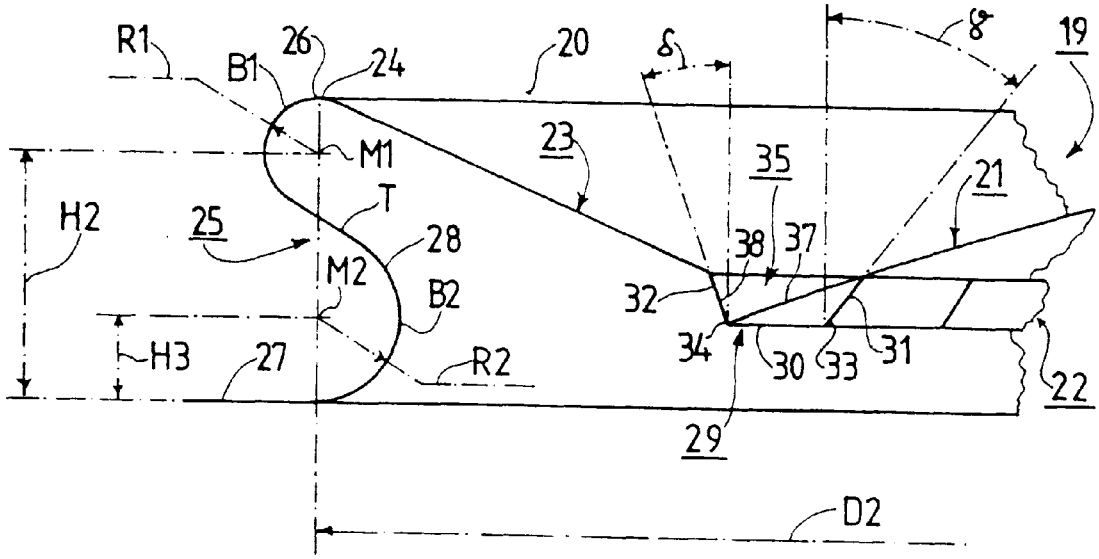
FIG. 5, in a view similar to that in FIG. 4, shows a further peripheral area of the diaphragm, which peripheral area is disposed diametrally opposite to the peripheral area shown in FIG. 4.

The annular intermediate zone 22 has angularly equi-spaced trough portions 29, as is apparent from FIGS. 3, 4 and 5. In the present case, the trough portions 29 are equi-spaced at angles of 18° from one another. As a result of this, the diaphragm 19 has ten (10) such trough portions 29 in total. The trough portions 29 are trough-shaped in cross-section. The trough portions 29 are each bounded by a trough bottom wall 30 and two trough side walls 31 and 32. Of the trough side walls 31 and 32, each radially inner trough side wall 31 adjoins the spherical central zone 21 and each radially outer trough side wall 32 adjoins the diverging peripheral zone 23. The trough portions are constructed in such a manner that in each of these trough portions 29, the trough bottom wall 30 is connected to the trough side walls 31 and 32 at those ends 33 and 34 of the trough side walls 31 and 32 which are remote from the free space 20 in front of the diaphragm 19.

The trough bottom walls 30 of the trough portions 29 form the actual mounting zone on the diaphragm 19 for securing the voice coil 17 of the transducer 1 to the diaphragm 19. The voice coil 17 is secured to the trough bottom walls 30, which are disposed in a plane perpendicular to the transducer axis 5, by means of an adhesive joint formed between each respective trough bottom wall 30 and the voice coil 17. Ten (10) adhesive joints in total, between the ten (10) trough bottom walls 30 and the voice coil 17 guarantee a reliable connection of the voice coil 17 to the diaphragm 19. Securing the voice coil 17 to the trough bottom walls 30 has the advantage that excess adhesive applied in order to form an adhesive joint can escape to the areas between the trough bottom walls 30, so that an undesired egress of excess adhesive is avoided.

Another advantageous feature of the transducer 1 is that, viewed in a tangential direction, a first wedge portion 35 adjoins each trough portion 29 at one end and a second wedge portion 36 at the other end. Each first wedge portion 35 is bounded by a radial prolongation 37 of the spherical central zone 21 of the diaphragm 19 and by a tangential prolongation 38 of the radially outer trough side wall 32 of the adjacent trough portion 29. Each second wedge portion 36 is bounded by a radial prolongation 39 of the diverging peripheral zone 23 of the diaphragm 19 and by a tangential prolongation 40 of the radially inner trough side wall 31 of the adjacent trough portion 29. The wedge portions 35 and 36 promote the stiffness of the annular intermediate zone 22 and thus of the entire diaphragm 19, which is advantageous in view of good acoustic properties of the transducer 1.

By forming the annular intermediate zone 22 with the aid of the trough portions 29, the advantage is obtained in the transducer 1 that the actual mounting zone for the voice coil 17, which zone is formed by the trough bottom walls 30 of the trough portions 29, is situated comparatively close to the air gap 16 of the magnet system 9 so that, in comparison with a known diaphragm having a flat annular intermediate zone, the dimension of the voice coil 17 in the direction of the transducer axis 5 can, in principle, be smaller by an amount equal to the depth of the trough portions. As a result of this, a comparatively short and therefore comparatively light-weight voice coil 17 is obtained, which requires only a comparatively small number of turns. Moreover, it is achieved that the voice coil 17 is disposed relatively symmetrically with respect to the air gap 16, which is advantageous in order to preclude non-linear distortion.

Hereinafter, some important dimensions of the diaphragm 19 and the supporting means 25 for the diaphragm 19 are discussed briefly. As is apparent from FIG. 2, the second annular zone 27 of the supporting means 25 has an outer diameter D1, which can be, for example, 12.4 mm. The inner diameter of the first annular zone 26 of the supporting means 25, which corresponds to the outer diameter of the annular outer zone 24 of the diaphragm 19, bears the reference symbol D2 in FIG. 2 and can, for example, be 11.4 mm. The frustoconical peripheral zone 23 has a flare angle J of, for example, 132°. The trough bottom walls 30 of the trough portions 29 are situated between two diameters referenced D3 and D4 in FIG. 2. The diameter D3 can be 8.4 mm and the diameter D4 can be 7.7 mm, for example. The radially inner trough side walls 31 have an angle of inclination K of, for example, 38.5°. The radially outer trough side walls 32 have an angle of inclination L of, for example 19°. As is also apparent from FIG. 2, the supporting means 25 have an overall height H1 in the direction of the transducer axis 5, which can be, for example, 1.1 mm. Said spacing, i.e., the distance D between the second annular zone 27 of the supporting means 25 and the diaphragm 19 can, for example, be 0.3 mm.

As is apparent from FIGS. 4 and 5, The S-shape of the connecting zone 28 of the supporting means 25 corresponds to an arc of circle B1 having a radius R1 and starting from the first annular zone 26, an arc of circle B2 having a radius R2 and starting from the second annular zone 27 , and a tangent line T which joins the two arcs of circle B1 and B2 to one another. The radius R1 can then, for example, be 0.2 mm and the radius R2 can then, for example, be 0.3 mm. The distance H2 from the center M1 of the arc of circle B1 to the axial level of the second annular zone 27 can be, for example, 0.9 mm. The distance H3 from the center M2 of the arc of circle B3 to the axial level of the second annular zone 27 can be for example, 0.3 mm.

The invention is not limited to the embodiments described hereinbefore. In a transducer 1 and a diaphragm 19 in accordance with the invention, the annular intermediate zone 22 between the central zone 21 and the peripheral zone 23 of the diaphragm 19 can alternatively comprise only trough portions 29 which are radially spaced from one another by a greater or smaller distance, diaphragm portions being disposed in the areas between the trough portions 29, which diaphragm portions are disposed at a level which extends parallel to the trough bottom walls 30 of the trough portions 29 but is spaced from the trough bottom walls 30 of the trough portions 29 in a direction towards the acoustic free space 20 in front of the diaphragm 19.

What is claimed is:

1. An electroacoustic transducer (1) comprising a voice coil (17) and a diaphragm (19) for cooperating with an air mass in an acoustic free space situated in front of the diaphragm (19), said diaphragm capable of being set into vibration by the voice coil (17) substantially parallel to an axis of the electroacoustic transducer, said diaphragm having an annular outer zone (24), a central zone (21) which is convex with respect to the acoustic free space situated in front of the diaphragm, and a peripheral zone (23) which diverges towards the acoustic free space, said peripheral zone (23) being connected to the central zone (21) by an annular intermediate zone (22) and terminating in the outer zone (24) of the diaphragm (19), the annular intermediate zone (22) of the diaphragm (19) being constructed for securing the voice coil (17) of the transducer (1) to the diaphragm (19), characterized in that the annular intermediate zone (22) has angularly spaced-apart trough portions (29) which are substantially trough-shaped in cross-section and which are each bounded by a trough bottom wall (30) and two trough side walls (31, 32), of which each radially inner trough side wall (31) adjoins the central zone (21) and each radially outer trough side wall (32) adjoins the peripheral zone (23), and in each of these trough portions (29) the trough bottom wall (30) is connected to the trough side walls (31, 32) at those ends (33, 34) of the trough side walls (31, 32) which are remote from the acoustic free space in front of the diaphragm (19).

2. An electroacoustic transducer (1) as claimed in claim 1, characterized in that, viewed in a tangential direction, a first wedge portion (35) adjoins each trough portion (29) at one end and a second wedge portion (36) adjoins each trough portion at the other end, and each first wedge portion (35) is bounded by a radial prolongation (37) of the central zone (21) of the diaphragm (19) and by a tangential prolongation (38) of the radially outer trough side wall (32) of the adjacent trough portion (29), and each second wedge portion (36) is bounded by a radial prolongation (39) of the peripheral zone (23) of the diaphragm (19) and by a tangential prolongation (40) of the radially inner trough side wall (31) of the adjacent trough portion (29).

3. An electroacoustic transducer as claimed in claim 1, characterized in that the diaphragm (19) is manufactured by a deep-drawing process.

4. A diaphragm (19) for an electroacoustic transducer (1), said diaphragm cooperating with an air mass in an acoustic free space situated in front of the diaphragm (19), said diaphragm capable of being set into vibration by a voice coil (17) substantially parallel to an axis of the electroacoustic transducer, said diaphragm having an annular outer zone (24), a central zone (21) which is convex with respect to the acoustic free space situated in front of the diaphragm, and a peripheral zone which diverges towards the acoustic free space in front of the diaphragm (19), said peripheral zone being connected to the central zone (21) by an annular intermediate zone (22) and terminating in the outer zone (24) of the diaphragm (19), the annular intermediate zone (22) of the diaphragm (19) being constructed for securing the voice coil (17) of the transducer (1) to the diaphragm (19), characterized in that the annular intermediate zone (22) has angularly spaced-apart trough portions (29) which are substantially trough-shaped in cross-section and which are each bounded by a trough bottom wall (30) and two trough side walls (31, 32), of which each radially inner trough side wall (31) adjoins the central zone (21) and each radially outer trough side wall adjoins the peripheral zone (23), and in each of these trough portions (29), the trough bottom wall (30) is connected to the trough side walls (31, 32) at those ends (33, 34) of the trough side walls which are remote from the acoustic free space in front of the diaphragm (19).

5. A diaphragm as claimed in claim 4, characterized in that, viewed in a tangential direction, a first wedge portion (35) adjoins each trough portion (29) at one end and a second wedge portion (36) adjoins each trough portion at the other end, and each first wedge portion (35) is bounded by a radial prolongation (37) of the central zone (21) of the diaphragm (19) and by a tangential prolongation (38) of the radially outer trough side wall (32) of the adjacent trough portion (29), and each second wedge portion (36) is bounded by a radial prolongation (39) of the peripheral zone (23) of the diaphragm (19) and by a tangential prolongation (40) of the radially inner trough side wall (31) of the adjacent trough portion (29).

6. A diaphragm (19) as claimed in claim 4, characterized in that the diaphragm is manufactured by a deep-drawing process.

* * * * *